US007611340B2

(12) United States Patent
Hwang et al.

(10) Patent No.: US 7,611,340 B2
(45) Date of Patent: Nov. 3, 2009

(54) COMPOSITE DRY VACUUM PUMP HAVING ROOTS AND SCREW ROTOR

(75) Inventors: Tae-Kyong Hwang, Gyeonggi-do (KR); Myung Keun Noh, Seoul (KR); Heaung Shig Oh, Gyeonggi-do (KR)

(73) Assignee: LOT Vacuum Co., Ltd. (KR)

( * ) Notice: Subject to any disclaimer, the term of this patent is extended or adjusted under 35 U.S.C. 154(b) by 80 days.

(21) Appl. No.: 11/878,665

(22) Filed: Jul. 26, 2007

(65) Prior Publication Data

US 2008/0025858 A1 Jan. 31, 2008

(30) Foreign Application Priority Data

Jul. 28, 2006 (KR) ..... 10-2006-0071730
Sep. 29, 2006 (KR) ..... 10-2006-0096281
Nov. 16, 2006 (KR) ..... 10-2006-0113370

(51) Int. Cl.
*F04C 18/18* (2006.01)
*F04C 25/02* (2006.01)

(52) U.S. Cl. ..... 418/9; 418/3; 418/200; 418/205; 418/206.5

(58) Field of Classification Search ..... 418/3, 418/9, 200, 196, 205, 206.5
See application file for complete search history.

(56) References Cited

U.S. PATENT DOCUMENTS 514,659 A * 2/1894 Morgan ..... 418/200
1,531,607 A * 3/1925 Green ..... 418/9
3,085,513 A * 4/1963 Zimmermann ..... 417/423.1
4,943,214 A * 7/1990 Niimura et al. ..... 418/9
5,088,902 A * 2/1992 Marioni ..... 417/415
5,549,463 A * 8/1996 Ozawa ..... 418/3
5,667,370 A * 9/1997 Im ..... 418/9
5,674,063 A * 10/1997 Ozaki et al. ..... 418/3
6,129,534 A * 10/2000 Schofield et al. ..... 418/3
6,379,135 B2 * 4/2002 Schofield ..... 418/194
6,465,924 B1 * 10/2002 Maejima ..... 310/90.5
6,538,353 B2 * 3/2003 Marioni ..... 310/89
2002/0158545 A1 * 10/2002 Marioni ..... 310/261
2003/0059325 A1 * 3/2003 Adams ..... 418/200
2004/0219045 A1 * 11/2004 Yoshimura et al. ..... 418/3
2006/0083651 A1 4/2006 Lim
2006/0292025 A1 * 12/2006 Sakata et al. ..... 418/205

* cited by examiner

*Primary Examiner*—Thomas E Denion
*Assistant Examiner*—Mary A. Davis
(74) *Attorney, Agent, or Firm*—David R. Yohannan, Esq.; Kelley Drye & Warren LLP

(57) ABSTRACT

A complex dry vacuum pump including a root rotor and a screw rotor is disclosed for manufacturing semiconductors and/or displays in a vacuum state in a process chamber, and discharging gaseous material and/or by-products generated during manufacturing to the exterior of the process chamber. The pump can provide high gas compression transfer efficiency so as to form a vacuum in the process chamber and/or keep high gas compression transfer efficiency when the gaseous material and/or by-products are discharged. Balance between the root rotor and the screw rotor can prevent vibration and noise generated in the vacuum pump, and molding material associated with the pump may allow a stator coil to be separated and prevent various by-products from flowing from the vacuum pump.

14 Claims, 5 Drawing Sheets

COMPOSITE DRY VACUUM PUMP HAVING ROOTS AND SCREW ROTOR

BACKGROUND OF THE INVENTION

1. Field of the Invention

The present invention relates to a dry vacuum pump, and more particularly to a complex dry vacuum pump having a root rotor and a screw rotor.

2. Description of the Prior Art

A dry vacuum pump have according to the state of the art includes at least one root rotor having a lobe and at least one screw rotor so as to keep a complete vacuum state in a process chamber and reduce costs of required power. The root rotor is connected with the process chamber so as to be used for sucking and compressing process by-products, including gaseous material generated in the process chamber. The screw rotor is used for discharging gas and process by-products, which are sucked by the root rotor, to an exterior of the process chamber. Under any circumstance, these rotors are operated in an airtight state so as to keep a vacuum state in the process chamber.

In general, a septal wall is provided between the side of such root rotors and the side of such screw rotors so as to cause process by-products not to interrupt rotation of the rotors and to smoothly move from the group of the root rotors to the group of the screw rotors. A representative embodiment of such a structure is disclosed in U.S. Pat. No. 5,549,463 filed in the name of Kashiyama Industry Co., Ltd (hereinafter, referring to FIG. 9).

According to this patent document, a dry vacuum pump 100 includes a pair of root rotors 102 and 103 and a pair of screw rotors 105 and 106. The pair of root rotors 102 and 103 and the pair of screw rotors 105 and 106 are driven by a single driving motor 200. A septal wall 108 is provided between the root rotors 102 and 103 and the screw rotors 105 and 106 so as to cause the above-mentioned process by-products from a process chamber (not shown) not to be directly transferred to the screw rotors 105 and 106. This patent document is included in the present document as a reference of the present invention.

However, a septal wall 108 required for a dry vacuum pump 100 disclosed in U.S. Pat. No. 5,549,463 is disposed between root rotors 102 and 103 and screw rotors 105 and 106. Particularly, a housing 107 including these rotors has to be divided into several parts. This increases the effort to manufacture such a dry vacuum pump and a number of components thereof.

Furthermore, additionally to a scheme using a septal wall, a scheme using a screw of a variable pitch has been attempted in a dry vacuum pump using screw rotors, so as to reduce amount of power consumption and increase the amount of a by-product which is pressed and discharged. However, this scheme needs a larger rotor and pump housing in comparison with a conventional scheme, thereby decreasing effectiveness.

Furthermore, a scheme allowing a root rotor and a screw rotor to be directly connected with each other without a septal wall disposed between them has been attempted. However, in this case, the root rotor and the screw rotor had to be designed in such a manner as to have sections similar to each other so as to increase gas compression transfer efficiency.

However, in a case of a root rotor and a screw rotor being designed in a similar shape, a negative effect is exerted on balance between the root rotor and the screw rotor, thereby causing serious vibration and noise in a vacuum pump.

Also, as shown in FIG. 9, a driving motor 200 used in a vacuum pump includes a stator 220, a rotator 230, a shaft 240, and a motor case 210.

When a conventional vacuum pump having such a structure is operated, a pair of root rotors 102 and 103 and a pair of screw rotors 105 and 106, which are in the interior of the vacuum pump, are rotated by driving of the driving motor 200, so that process by-products are sucked through a suction opening (not shown) of the vacuum pump, pass through the interior of the vacuum pump, and are discharged via a discharge opening (not shown). Therefore, a process chamber of an apparatus for manufacturing a semiconductor and a display is put in a vacuum state. In this time, when process by-products sucked by rotation of the pair of root rotors 102 and 103 and the pair of screw rotors 105 and 106 pass through the interior of the vacuum pump and are discharged via a discharge opening, a part of the process by-products flow in the interior of the driving motor 200. The process by-products flowing in the interior in such a manner cause damage of a stator coil 220*a* so that the lifecycle of the driving motor 200 is reduced.

Therefore, a can 400 is installed between a stator 220 and a rotator 230 so as to prevent damage of a stator coil 220*a* caused by process by-products flowing from a conventional vacuum pump. Such a can 400 is a sheet made of material such as stainless steel, etc., and is welded in a circular shape. The can 400 is installed between the stator 220 and the rotator 230, thereby preventing damage to the stator coil 220*a* due to process by-products or lubricating oil flowing from the vacuum pump.

However, the can 400 installed between the stator 220 and the rotator 230 has to be disposed in a minute gap between the stator 220 and the rotator 230, so it is difficult to manufacture and assemble the can 400.

Also, the can installed between the stator 220 and the rotator 230 causes loss of own power of a motor, so that a large amount of power consumption of the motor is caused, thereby increasing operation costs.

SUMMARY OF THE INVENTION

Accordingly, the present invention has been made to solve the above-mentioned problems occurring in the prior art, and the present invention provides a complex dry vacuum pump including a root rotor and a screw rotor, which can keep high gas compression transfer efficiency either during discharge of process by-products and/or gaseous material generated in a process chamber of an apparatus for manufacturing a semiconductor or display or while creating a vacuum in the process chamber, and can keep balance between the root rotor and the screw rotor, so as to prevent vibration and noise generated in the vacuum pump.

In accordance with an aspect of the present invention, there is provided a motor for a high efficiency vacuum pump, which can protect a stator coil from various by-products flowing from a vacuum pump.

In accordance with another aspect of the present invention, there is provided a complex dry vacuum pump including a root rotor and a screw rotor, including: a housing having an interior receiving space, a suction opening on one side of the housing, and a discharge opening on the other side of the housing; first and second root rotors which are received in the interior receiving space of the housing and are the first and second root rotors being installed in such a manner as to be engaged with each other; first and second screw rotors which are received in the interior receiving space of the housing and are installed in such a manner as to be engaged with each other adjacent to the first and second root rotors; first and second power transmission shafts extending through each center of the first and second root rotors and the first and second screw rotors; first and second gears connected with the first and second power transmission shafts, respectively, while being engaged with each other; and a motor having a rotor connected with the first power transmission shaft in such a manner that the rotor can be rotated in an interior of a stator, the stator having a coil wound in the stator and being included in an interior of a case, wherein the first and second root rotors include three lobes, respectively, and molding material is molded in the stator so as to protect the coil from various by-products flowing in the interior of the housing.

According to a complex dry vacuum pump including a root rotor and a screw rotor, high gas compression transfer efficiency can be kept either during discharge of process by-products and/or gaseous material, which are generated in a process chamber of an apparatus for manufacturing a semiconductor or display, or while creating a vacuum in the process chamber. Furthermore, vibration and noise are prevented from being generated in the vacuum pump, and a stator coil can be protected from process by-products flowing from the vacuum pump, thereby improving reliability of a motor.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE EXEMPLARY EMBODIMENTS

Hereinafter, a complex dry vacuum pump including a root rotor and a screw rotor according to the first exemplary embodiment of the present invention, will be described in more detail with reference to the accompanying drawings.

Figure 1:
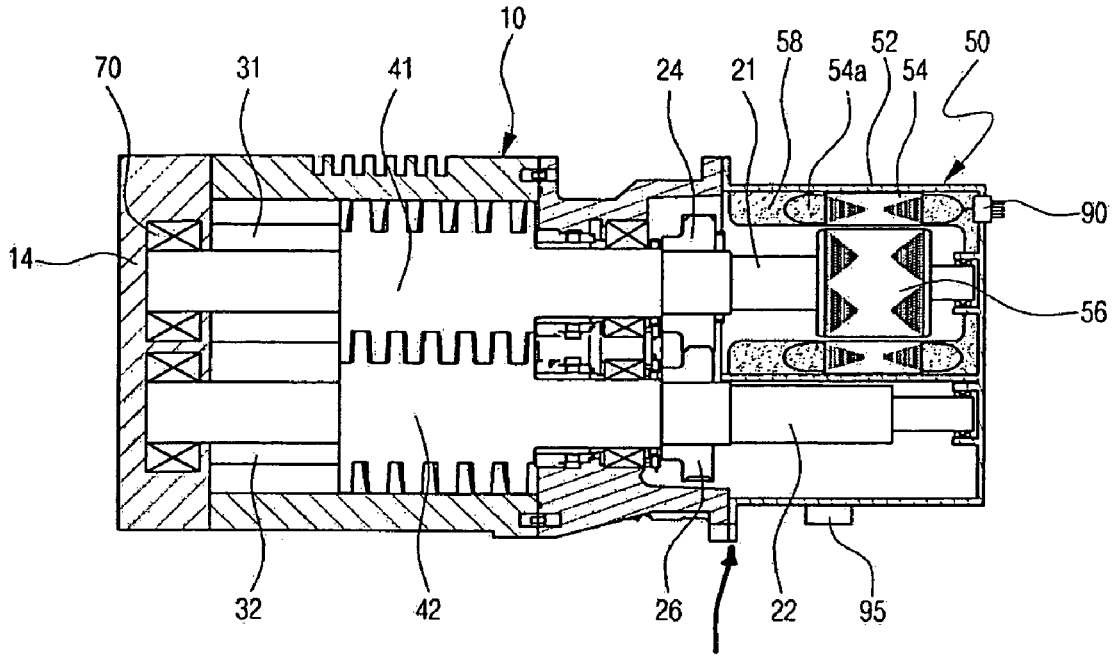
FIG. 1 is a schematic cross sectional view of a complex dry vacuum pump including a root rotor and a screw rotor according to the first exemplary embodiment of the present invention.
Figure 2:
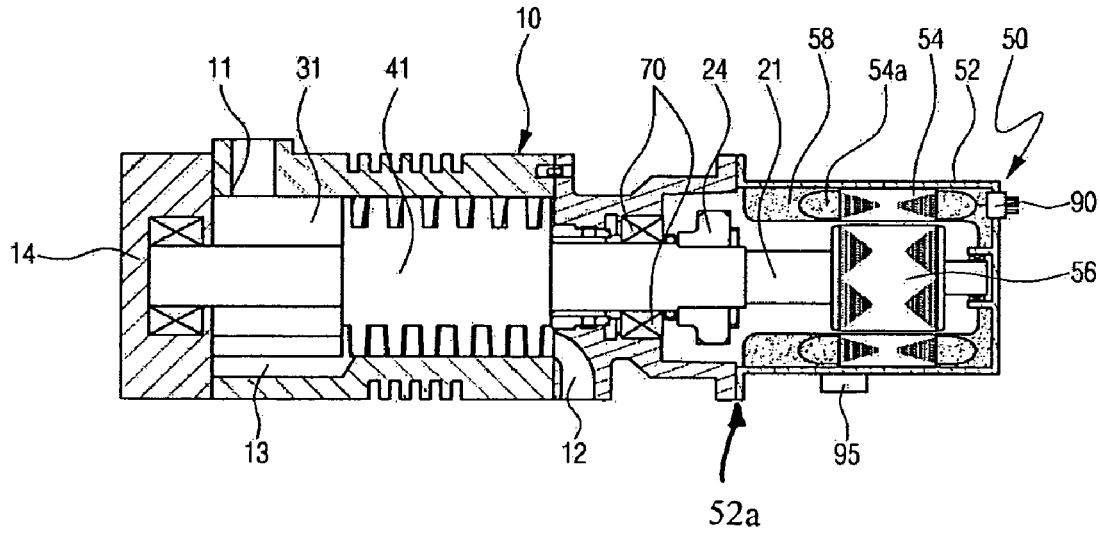
FIG. 2 is a schematic vertical sectional view of the complex dry vacuum pump including a root rotor and a screw rotor shown in FIG. 1.
Figure 3:
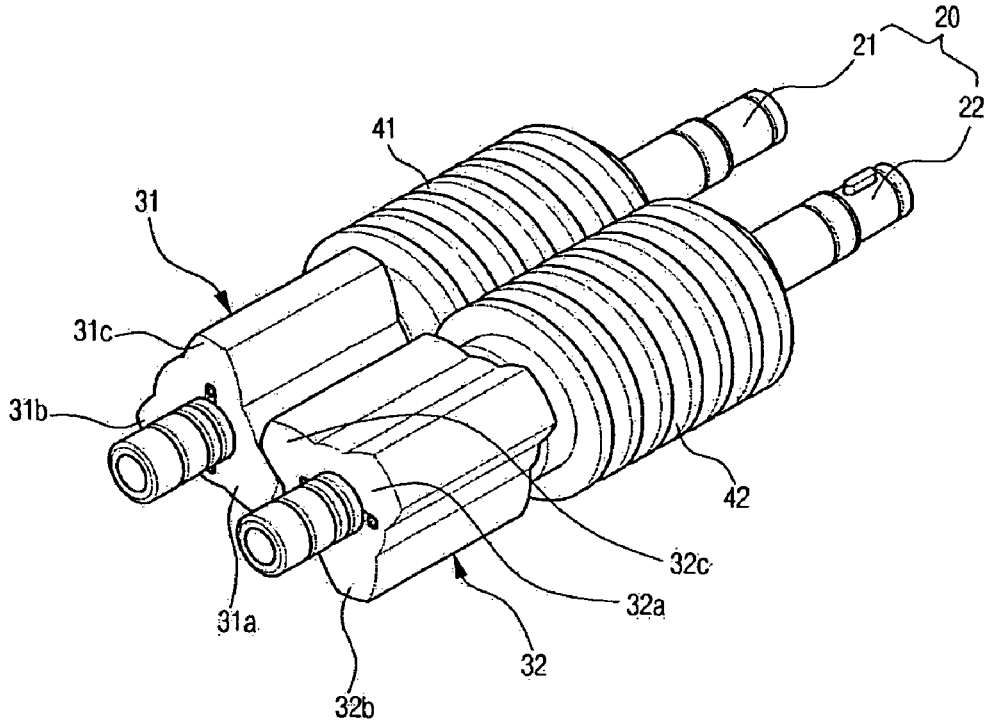
FIG. 3 is a perspective view illustrating a root rotor and a screw rotor of the complex dry vacuum pump including the root rotor and screw rotor shown in FIG. 1.

FIG. 1 is a cross sectional view of a complex dry vacuum pump including a root rotor and a screw rotor according to the first exemplary embodiment of the present invention, FIG. 2 is a vertical sectional view of the complex dry vacuum pump including the root rotor and screw rotor shown in FIG. 1, and FIG. 3 is a perspective view illustrating a root rotor and a screw rotor of the complex dry vacuum pump including the root rotor and screw rotor shown in FIG. 1.

As shown in FIGS. 1 and 3, a complex dry vacuum pump including a root rotor and a screw rotor according to the first exemplary embodiment of the present invention includes: a suction opening 11 on one side thereof; a discharge opening 12 on another side thereof; a housing 10 having an interior receiving space; the first and second root rotors 31 and 32 which are received in the interior receiving space of the housing 10 and are engaged with each other; and the first and second screw rotors 41 and 42 which are engaged with each other adjacent to the first and second root rotors 31 and 32. The complex dry vacuum pump also includes the first and second power transmission shafts 21 and 22 extending through each center of the first and second root rotors 31 and 32 and the first and second screw rotors 41 and 42; the first and second gears 24 and 26 which are assembled with the first and second power transmission shafts 21 and 22 while being engaged with them, respectively; a stator 54 which has a coil 54*a* wound therein and is included in the interior of a case 52; and a driving motor 50 including a rotor 56 connected with the first power transmission shaft 21 in such a manner that the rotor 56 can be rotated in the interior of the stator 54.

Hereinafter, such a structure will be described in more detail.

The housing 10 has an airtight space in its interior so as to form a vacuum and includes the suction opening 11 formed on one side thereof and the discharge opening 12 formed on another side thereof. The air of an environment to be a vacuum is sucked out via the suction opening 11 and, such air is discharged to the exterior via the discharge opening 12. Furthermore, a predetermined space 13 allowing material to be sucked out to remain is formed in the housing corresponding to each lower part of the first root rotor 31 and second root rotor 31.

The first root rotor 31 includes three lobes 31*a*, 31*b*, and 31*c*, the second root rotor 32 includes three lobes 32*a*, 32*b*, and 32*c*, and they are all located in the interior receiving space of the housing 10. The three lobes of each rotor 31*a*, 31*b*, 31*c*, 32*a*, 32*b*, 32*c* are rotated while being engaged with each other so as to inhale air and transfer the air to the first and second screw rotors 41 and 42. One lobe 31*a* among 31*a*, 31*b*, 31*c* and one lobe 32*a* among 32*a*, 32*b*, 32*c* have a shorter length from the center of rotation to each end of the lobes 31*a* and 32*a* in comparison with the corresponding two lobes of each root rotor 31*b*, 31*c*, 32*b*, 32*c*. Parts 31*d* and 32*d* positioned opposite to the lobes 31*a* and 32*a* which have a shorter length are formed in each shape corresponding to the lobes 31*a* and 32*a* which have a shorter length in such a manner so as to make contact with the lobes 31*a* and 32*a* while they are rotated so as to be airtight.

Particularly, a part 31*d* positioned opposite to the lobe 31*a* having a short length in the first root rotor 31 comes into contact with the lobe 32*a* having a short length in the second root rotor 32. Meanwhile, a part 32*d* positioned opposite to the lobe 32*a* having a short length in the second root rotor 32 comes into contact with the lobe 31*a* having a short length in the first root rotor 31.

The first and second screw rotors 41 and 42 have shapes corresponding to each other as a pair. The two screw rotors 41 and 42 are rotated while being engaged with each other, so that gas can be continuously sucked, compressed, and discharged by change of volume formed between grooves of the first and second screw rotors 41 and 42 and the housing 10. Furthermore, diameters of the first and second screw rotors 41 and 42 are gradually shortened from the suction opening 11 toward the discharge opening 12 by considering the fact that the first and second screw rotors 41 and 42 have heat expansion due to heat of the interior of the housing 10 so that rotation thereof is interfered with friction with the interior of the housing 10.

The power transmission shafts 21 and 22 include the first power transmission shaft 21 extending through each center of the first root rotor 31 and the first screw rotor 41, and second power transmission shaft 22 extending through each center of the second root rotor 32 and the second screw rotor 42. The first power transmission shaft 21 and the second power transmission shaft 22 have the first and second gears 24 and 26, respectively, which are formed in such a manner as to be rotated while being engaged with each other. A driving motor 50 is installed at one end of the first transmission shaft 21, and a plurality of bearings 70 are coupled with both ends of each of the first and second power transmission shafts 21 and 22.

Meanwhile, at the suction opening 11 in which a vacuum state and an atmospheric state can be repeatedly exchanged with each other when the pump is operated, grease for lubricating can escape from the bearings 70, which supports the first and second root rotors 31 and 32 and the first and second screw rotors 41 and 42, due to a difference in pressure, thereby causing damage to the vacuum pump. Therefore, the bearings 70 can be coupled only with one of both ends of each of the first and second power transmission shafts 21 and 22, i.e. one end of each of the first and second power transmission shafts 21 and 22.

The driving motor 50 includes the stator 54, which has a coil 54*a* wound therein and is included in the interior of the case 52 and a rotator 56 connected with the first power transmission shaft 21 in such a manner that the rotor 56 can be rotated in the stator 54. Molding material for protecting the coil 54*a* from various by-products flowing from the vacuum pump is formed by molding in the stator 54.

Such a structure will be described in more detail hereinafter.

The stator 54 having a coil 54*a* wound therein and the rotor 56 connected with the first power transmission shaft 21 in such a manner that the rotor 56 can be rotated in the stator 54 are installed in the interior receiving space of the case 52. Molding material is molded in the peripheral area of the stator coil 54*a* so as to prevent the coil 54*a* from being exposed. Such molding material is molded at a predetermined interval so as not to be interfered with rotation of the rotor 56. Epoxy resin 58 having a superior chemistry-proof property and thermal conductivity can be used as molding material surrounding the peripheral area of the coil 54*a*.

Herein, it is noted that the driving motor 50 according to the exemplary embodiment of the present invention does not have a can 200 installed between a stator 54 and a rotor 56, in comparison with a conventional driving motor 104. In the conventional driving motor 104, a stator coil 120*a* is completely sealed off by means of a can 200 so as to protect the stator coil 120*a* from various by-products flowing from a vacuum pump as mentioned-above. However, such a can 200 is installed between a stator 120 and a rotator 130 so that a large amount of power consumption of the driving motor 100 is caused due to loss of own power, and it was easy to cause damage to the stator coil 120*a* since the stator coil 120*a* is exposed to various by-products flowing from the vacuum pump 300. These problems can be resolved by this present invention. In an exemplary embodiment of the present invention, a motor 50 using epoxy resin 58 having a superior chemistry-proof property and thermal conductivity instead of such a can 200 is be provided. The epoxy resin 58 is molded in the peripheral area of the stator coil 54*a* so as to prevent the stator coil 54*a* from being exposed. Therefore, the stator coil 54*a* can be separated from various by-products flowing from a vacuum pump and be protected, and there is no loss of own power caused between a stator 54 and a rotator 56. Furthermore, heat generated in the stator coil 54*a* can be conducted by the epoxy resin 58 having superior thermal conductivity and can be quickly discharged to an exterior.

Furthermore, as such a driving motor 50, various kinds of motors may be used according to the desired power. A water-cooled motor is used in a complex dry vacuum pump having a root rotor and a screw rotor, according to the exemplary embodiment of the present invention.

Also, so as to prevent outer air from flowing in the interior of the case 52, a joint part 52*a* of the case 52 is welded, an O-ring is installed in the joint part of the case 52, or the case 52 may be integrally formed.

Such a structure makes it possible to prevent outer air from flowing into the interior of the case 52 so that airtight sealing of the interior of the case 52 can be secured.

Also, an airtight device 90 for preventing outer air from flowing in the interior of the case 52 is mounted on one side of the case 52. In the conventional art, even though outer air flows inside through a gap of an electric device 500 installed on one side of the case 210, the airtight device 90 is kept in an airtight state by means of a can 400 installed in the interior of the case 210. However, in the present invention, the case 52 functions as the conventional can 400 so that an airtight device 90 for preventing outer air from flowing in the interior of the case 52 is preferably installed in the case 52.

Furthermore, a control member 95 for controlling 15 frequency of the motor 50 is further included on one side of the case 52. The reason why the control member 95 is included on one side of the case 52 is that the control member 95 is cooled by using cooling water of the motor 50 so as to prevent overheat generated in the control member 95.

As such, it is possible to prevent the stator coil 54*a* from various by-products flowing from the vacuum pump by molding epoxy resin 58 in the peripheral area of the stator coil 54*a*, so that a motor 50 having high efficiency can be provided.

A complex dry vacuum pump having a root rotor and a screw rotor, which has such a structure, will be described hereinafter.

Figure 4:
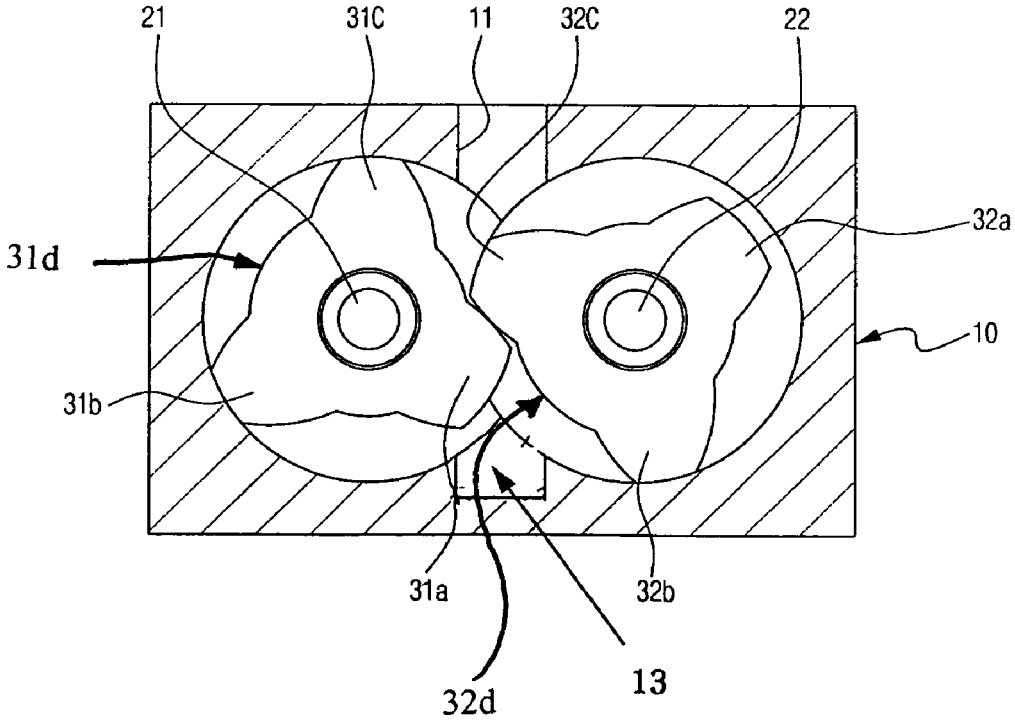
FIG. 4 is a schematic view illustrating the operation of the complex dry vacuum pump including a root rotor and a screw rotor according to the first exemplary embodiment of the present invention.

Firstly, as shown in FIGS. 2 and 4, when the driving motor 50 is driven, the first power transmission shaft 21 connected to the driving motor 50 is rotated, along with the rotation of the driving motor 50, the first gear 24 of the first power transmission shaft 21 and the second gear 26 engaged with the first gear 24 are rotated so that the first and second root rotors 31 and 32 and the first and second screw rotors 41 and 42 are rotated.

As the first and second root rotors 31 and 32 are rotated while being engaged with each other, the first and second root rotors 31 and 32 suck and compress air through the suction opening 11. In succession, the air is discharged through the first and second screw rotors 41 and 42.

Particularly, when the first and second root rotors 31 and 32 and the first and second screw rotors 41 and 42 are rotated, one lobe 31*a* among three lobes 31*a*, 31*b*, 31*c* and one lobe 32*a* among three lobes 32*a*, 32*b*, 32*c* have a short length, so that the first and second root rotors 31 and 32 compress the sucked air two times and transfer the air to the first and second screw rotors 41 and 42. The air transferred to the first and second screw rotors 41 and 42 is distributed respectively into the first and second screw rotors 41 and 42 so as to be discharged through the discharge opening 12.

Therefore, as the first and second root rotors 31 and 32 and the first and second screw rotors 41 and 42 are rotated one full turn, the operations of suction and compression and discharge are simultaneously performed so that sucked gas is successively transferred. Furthermore, the balance between the first and second root rotors 31 and 32 and the first and second screw rotors 41 and 42 are kept so that vibration and noise generated in the vacuum pump can be prevented.

Particularly, the first and second root rotors 31 and 32 are designed in such a manner as to have a shape including three lobes 31*a*, 31*b*, 31*c*, 32*a*, 32*b*, 32*c*, respectively, which are similar to shapes of the first and second screw rotors 41 and 42 and can keep balance while keeping high gas compression transfer efficiency. Therefore, vibration and noise generated in the vacuum pump can be prevented. By controlling lengths of one lobe among three lobes 31*a*, 31*b*, 31*c*, of the first root rotor 31 and one lobe 32*a* among three lobes 32*a*, 32*b*, 32 of the second root rotor 32, operations of sucking and discharging from the first and second root rotors 31 and 32 to the first and second screw rotors 41 and 42 are successively performed. If the lengths can not be controlled, intermittence of fluid flow of the interior is generated when gas is transferred from the first and second root rotors 31 and 32 to the first and second screw rotors 41 and 42. However, the intermittence can be removed when the lengths are controlled, so that vibration and noise caused by the intermittence can be minimized. Furthermore, as contact area between external diameters of the first and second root rotors 31 and 32 and an internal diameter of the housing 10 is reduced, wear caused by friction decreases so that the life of the vacuum pump can be extended.

Figure 5:
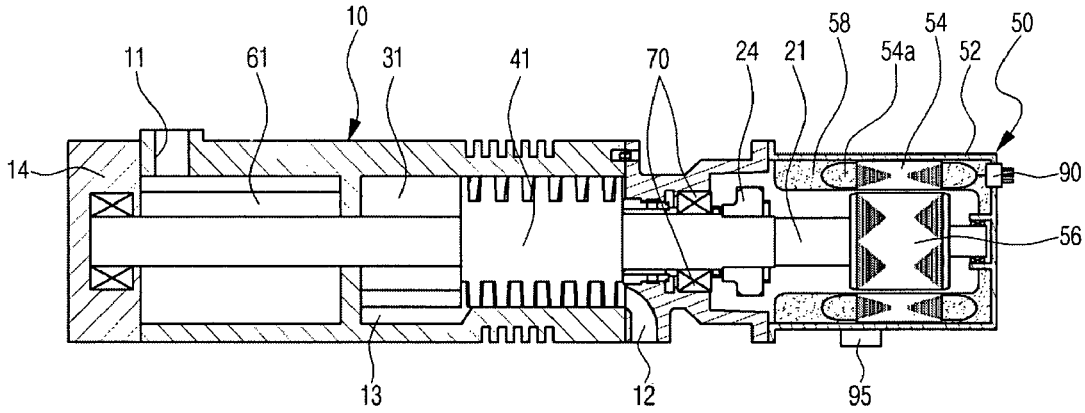
FIG. 5 is a schematic cross sectional view of a complex dry vacuum pump including a root rotor and a screw rotor according to the second exemplary embodiment of the present invention.
Figure 6:
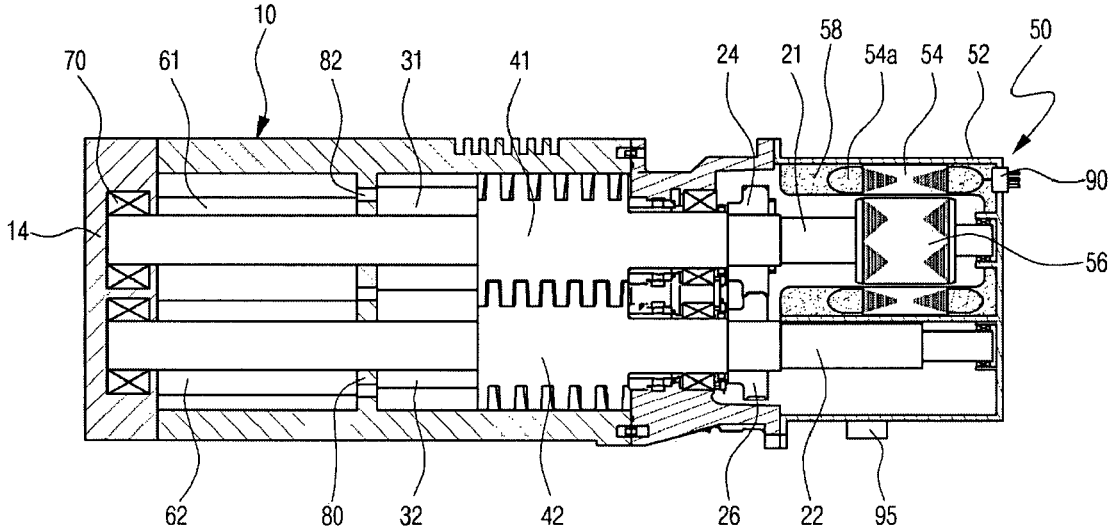
FIG. 6 is a schematic vertical sectional view of the complex dry vacuum pump including the root rotor and screw rotor, shown in FIG. 5.

FIG. 5 is a cross sectional view of a complex dry vacuum pump including a root rotor and a screw rotor, according to the second exemplary embodiment of the present invention, and FIG. 6 is a schematic vertical sectional view of the complex dry vacuum pump including the root rotor and screw rotor shown in FIG. 5.

As shown in FIGS. 5 and 6, the complex dry vacuum pump including a root rotor and a screw rotor, according to the second exemplary embodiment of the present invention, includes the third and fourth root rotors 61 and 62 which are assembled with one side of each of the first and second root rotors 31 and 32, respectively. The third and fourth root rotors 61 and 62 have lengths longer than those of the first and second root rotors 31 and 32 and have a plurality of lobes formed while making a pair of them. The complex dry vacuum pump also includes a septal wall 80, which has a flow opening 82, formed between the first and second root rotors 31 and 32 and the third and fourth root rotors 61 and 62. Except for such a structure, the complex dry vacuum pump is equal to that according to the first embodiment.

The complex dry vacuum pump including a root rotor and a screw rotor, which has the above-mentioned structure, includes the third and fourth root rotors 61 and 62 having lengths longer than lengths of the first and second root rotors 31 and 32. Therefore, interior volume of the housing 10 containing the third and fourth root rotors 61 and 62 increases so that amount of sucked air increases. Accordingly, the amount of transfer and the amount of discharge increase so that an environment requiring a vacuum state can be rapidly formed.

Figure 7:
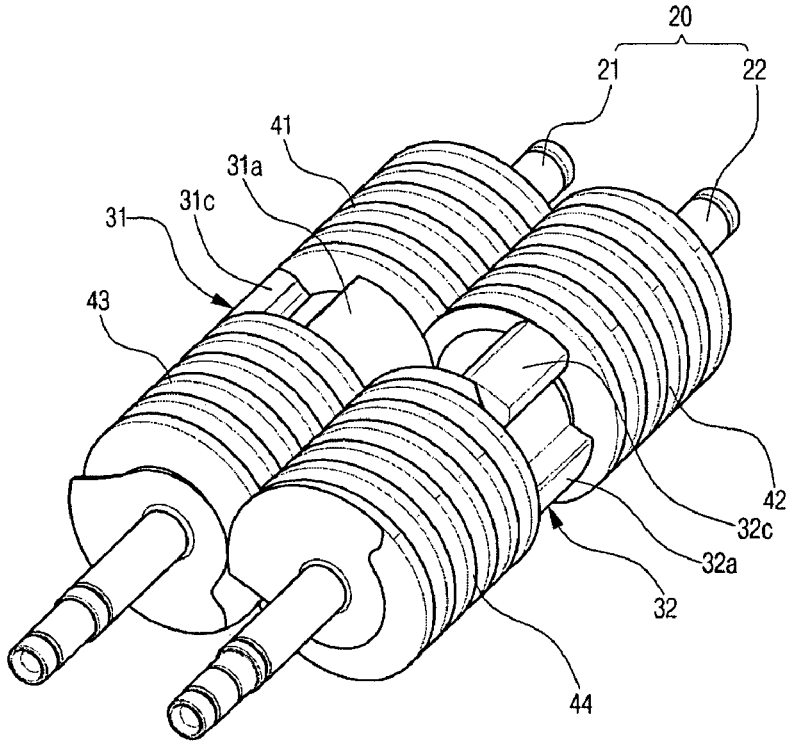
FIG. 7 is a perspective view of a complex dry vacuum pump including a root rotor and a screw rotor, according to the third exemplary embodiment of the present invention.
Figure 8:
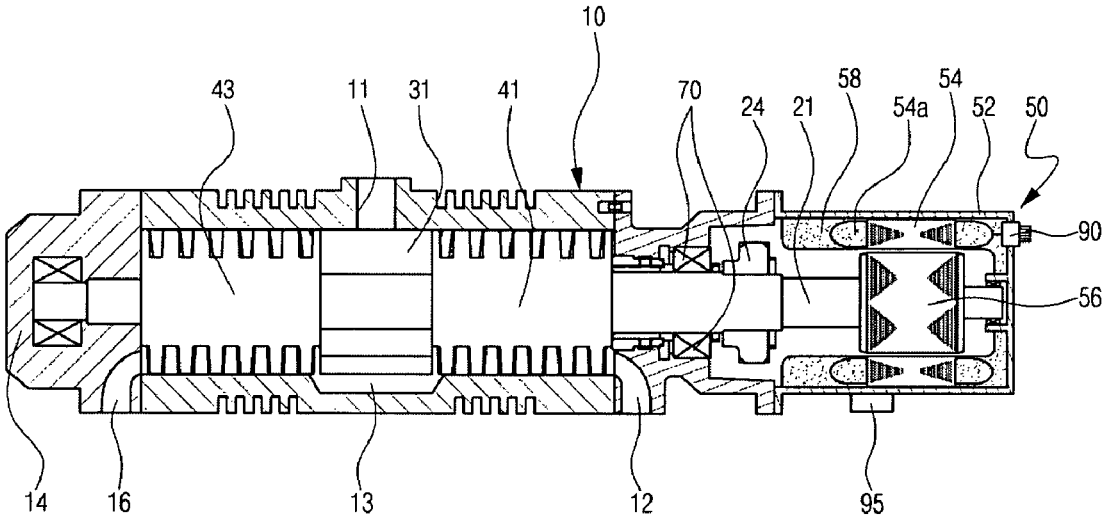
FIG. 8 is a schematic cross sectional view of the complex dry vacuum pump including a root rotor and a screw rotor, shown in FIG. 7.
Figure 9:
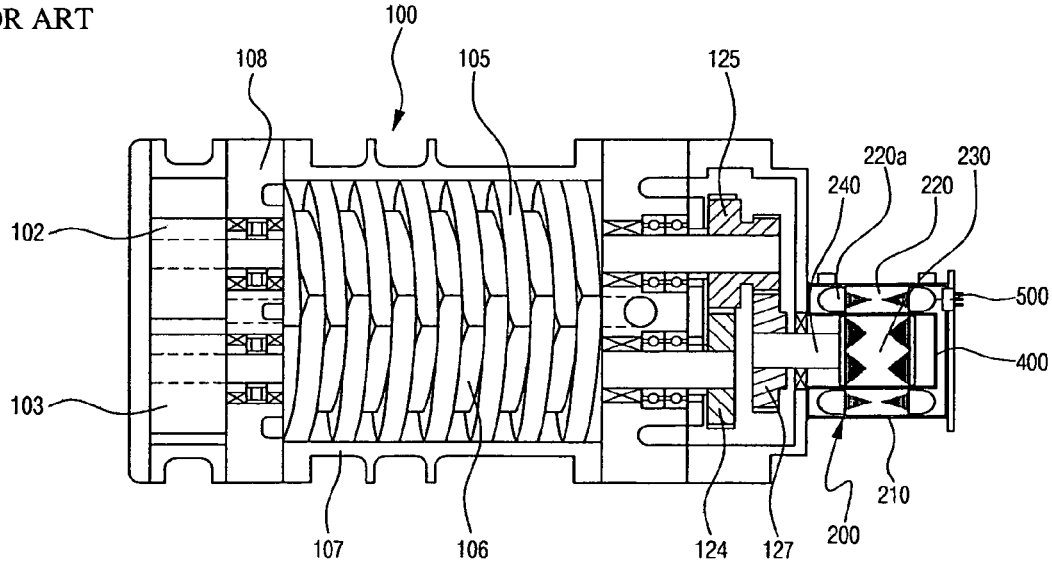
Fig. 9 PRIOR ART
FIG. 9 is a schematic cross sectional view of a conventional dry vacuum pump.

FIG. 7 is a perspective view of a complex dry vacuum pump including a root rotor and a screw rotor according to the third exemplary embodiment of the present invention, and FIG. 8 is a cross sectional view of the complex dry vacuum pump including the root rotor and screw rotor shown in FIG. 7.

As shown in FIGS. 7 and 8, the complex dry vacuum pump including a root rotor and a screw rotor according to the third exemplary embodiment of the present invention further includes the third and fourth screw rotors 43 and 44 which are formed on one side of each of the first and second root rotors 31 an 32, respectively, and a discharge opening 16 formed in the housing corresponding to the lower part of each of the third and fourth screw rotors 43 and 44. Except for such a structure, the complex dry vacuum pump is equal to that according to the first embodiment.

In the complex dry vacuum pump including a root rotor and a screw rotor, which has such a structure, gaseous material and/or process by-products, which are generated in a process chamber, are sucked into the first and second root rotors 31 and 32. The sucked gaseous material and/or the process by-products are transferred through the first, second, third, and fourth screw rotors 41, 42, 43, and 44, which are included at both ends of each of the first and second root rotors 31 and 32, respectively, and are discharged via respective discharge openings 12 and 16. Therefore, the amount of transfer and the amount of discharge increase so that an environment requiring a vacuum state can be rapidly formed.

As mentioned above, the complex dry vacuum pump including a root rotor and a screw rotor according to the present invention can keep high gas compression transfer efficiency either during discharge of process by-products and/or gaseous material generated in a process chamber of an apparatus for manufacturing a semiconductor or display or while creating a vacuum in the process chamber, and can keep balance between the root rotor and the screw rotor, so as to prevent vibration and noise generated in the vacuum pump. Furthermore, molding material is molded so as to allowing a stator coil to be separated and prevented from various by-products flowing from the vacuum pump. Therefore, the complex dry vacuum pump has no difficulty in being assembled or being manufactured and can prevent loss of power of a motor, thereby providing a motor having high efficiency.

Although an exemplary embodiment of the present invention has been described for illustrative purposes, those skilled in the art will appreciate that various modifications, additions and substitutions are possible, without departing from the scope and spirit of the invention as disclosed in the accompanying claims.

What is claimed is:

1. A complex dry vacuum pump including a root rotor and a screw rotor, comprising:

a housing having an interior receiving space, a suction opening at one side of the housing, and a discharge opening at another side of the housing;

first and second root rotors which are located in the interior receiving space of the housing and are installed in such a manner as to be engaged with each other;

first and second screw rotors which are received in the interior receiving space of the housing and are installed in such a manner as to be engaged with each other adjacent to the first and second root rotors;

first and second power transmission shafts extending through each center of the first and second root rotors and the first and second screw rotors;

and a motor which is able to rotate the first and second power transmission shafts;

wherein the first and second root rotors include three lobes, and wherein one lobe among the three lobes of the first root rotor has a length from the center of rotation to the end of the lobe shorter than lengths of the remaining two lobes of the three lobes of the first root rotor, and a part of the second root rotor has a shape that makes contact with the lobe of the first root rotor having a shorter length while the first and second root rotors are being rotated.

2. The complex dry vacuum pump including a root rotor and a screw rotor, as claimed in claim 1, wherein third and fourth root rotors, which have lengths longer than lengths of the first and second root rotors and have a plurality of lobes formed while making a pair of lobes, are assembled with one side of each of the first and second root rotors, and a septal wall having a flow opening is formed between the first and second root rotors and the third and fourth root rotors.

3. The complex dry vacuum pump including a root rotor and a screw rotor, as claimed in claim 1, wherein third and fourth screw rotors are further included on one side of each of the first and second root rotors, and a discharge opening is further included in the housing corresponding to the lower part of each of the third and fourth screw rotors.

4. The complex dry vacuum pump including a root rotor and a screw rotor, as claimed in one of claim 1, wherein the first and second screw rotors have diameters which are gradually shortened from the suction opening toward the discharge opening.

5. The complex dry vacuum pump including a root rotor and a screw rotor, as claimed in claim 1, wherein a predetermined space allowing material to be sucked to remain is formed in a lower part of the housing relative to the first and second root rotors and the suction inlet.

6. The complex dry vacuum pump including a root rotor and a screw rotor, as claimed in claim 1, wherein a plurality of bearings for enabling the first and second power transmission shafts to be smoothly rotated are included on one end of each of the first and second power transmissions shafts.

7. The complex dry vacuum pump including a root rotor and a screw rotor, as claimed in claim 6, wherein the motor has a motor rotor connected with the first power transmission shaft in such a manner that the motor rotor can be rotated in an interior of a stator, the stator has a coil wound inside and being included in the interior of a case, and molding material is molded in the stator so as to protect the coil from various by-products flowing in the interior of the housing.

8. The complex dry vacuum pump including a root rotor and a screw rotor, as claimed in claim 7, wherein the molding material is epoxy resin.

9. The complex dry vacuum pump including a root rotor and a screw rotor, as claimed in claim 8, wherein an airtight device is installed in one side of the case so as to prevent outer air from flowing into the interior of the case.

10. The complex dry vacuum pump including a root rotor and a screw rotor, as claimed in claim 9, further comprising a means for preventing outer air from flowing into the interior of the case.

11. The complex dry vacuum pump including a root rotor and a screw rotor, as claimed in claim 10, wherein the means for preventing outer air from flowing into the interior of the case is formed by molding the case.

12. The complex dry vacuum pump including a root rotor and a screw rotor, as claimed in claim 10, wherein the means for preventing outer air from flowing into the interior of the case is formed by welding a joint part of the case.

13. The complex dry vacuum pump including a root rotor and a screw rotor, as claimed in claim 10, wherein the means for preventing outer air from flowing into the interior of the case comprises an O-ring installed at a joint part of the case.

14. The complex dry vacuum pump including a root rotor and a screw rotor, as claimed in one of claims 11-13, wherein a control member for controlling frequency of a motor is further included on one side of the case.

* * * * *